US011148174B1

(12) United States Patent
Zbinden

(10) Patent No.: US 11,148,174 B1
(45) Date of Patent: Oct. 19, 2021

(54) ELECTRICAL INSULATOR MANUAL CLEANING DEVICE

(71) Applicant: Adam Zbinden, Walnut Creek, CA (US)

(72) Inventor: Adam Zbinden, Walnut Creek, CA (US)

( * ) Notice: Subject to any disclaimer, the term of this patent is extended or adjusted under 35 U.S.C. 154(b) by 34 days.

(21) Appl. No.: 16/875,248

(22) Filed: May 15, 2020

(51) Int. Cl.
*B08B 1/00* (2006.01)
*H01B 17/52* (2006.01)

(52) U.S. Cl.
CPC ..... *B08B 1/006* (2013.01); *H01B 17/52* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 1,568,408 | A * | 1/1926 | Miles | H02G 1/02 | 15/28 |
| 2,856,625 | A * | 10/1958 | Jean | A47L 4/02 | 15/244.1 |
| 5,448,793 | A * | 9/1995 | Mallory | A47L 1/06 | 15/121 |
| 2020/0061676 | A1 * | 2/2020 | Chundi | B08B 1/04 | |

* cited by examiner

*Primary Examiner* — Erin F Bergner

(57) ABSTRACT

The present invention relates to a manual device for cleaning high voltage electrical insulators, where a swiveling handle controls multiple prongs which feature branching heads which connect to spongiform cleaning attachments and flexible rubber blade attachments, which extend into the regions between the insulator discs to wash and remove contamination, while allowing the device operator to remain electrically insulated from the discs being cleaned.

1 Claim, 4 Drawing Sheets

ELECTRICAL INSULATOR MANUAL CLEANING DEVICE

BACKGROUND OF THE INVENTION

Electrical insulators play a vital role in the high voltage power transmission and distribution system. They maintain electrical isolation between energized equipment and earth ground potential. When insulators fail, catastrophic flashover can occur, resulting in potential damage to the system. One contributing factor leading to insulator failure is dirt or dust accumulation on the insulator disc surfaces. Particles at sufficient concentrations will form a conductive path, which the energized conductor can provide fault current to, resulting in current flowing over and along the insulator disc surfaces. This unintended current flow, resulting from surface particles which have sufficiently low resistivity to conduct current at the insulator's rated line voltage, will mechanically stress the insulator material, leading to premature mechanical failure of the insulator, as seen by a reduction of measured insulation resistance to inoperably low levels.

For the cleaning of post insulator structures, which feature stacks of discs, accessing the inter-disc region for cleaning purposes can be challenging. The concave regions between the insulator discs can accumulate particles and retain them despite initial cleaning efforts. A device which can efficiently, and completely clean bushing insulators is desirable, using glass cleaning methods which are adapted to the geometry of a bushing insulator.

SUMMARY OF THE INVENTION

The proposed device has several advantages for maintenance personnel tasked with cleaning insulation discs. The device has multiple prongs and will clean a minimum of 3 to 4 insulation discs at a time. It can be operated with one hand, which can be significant if working at heights. It introduces solvent and scrubs the insulator disc surface, with the spongiform side of its head, and then wipes and squeegees the surface with the rubber bladed side. In cooperation with a belt-mounted solvent container for continual refreshing of the sponge, the device can exhaustively clean large stacks of insulators in minimal amounts of time, optimizing the routine of an important electrical maintenance task. It can also be constructed of electrically insulating materials, such that the device is rated to operate safely at high voltages. It thus offers improvements in speed, efficiency, and safety relative to existing methods for cleaning high voltage insulator discs. The cleaning device also maintains a degree of separation between the maintenance personnel and the insulator discs, which is advantageous because it is electrically insulated and protects the user from high voltage sources, and protects the fragile nature of the often-glass insulator discs from inadvertent damage, as all contact surfaces on the device are soft and deforming. The cleaning attachments must extend sufficiently far from the support prong member to which they are attached, such that the inter-disc void regions of the insulator stack are completely covered with cleaning attachment surfaces, while the handle, support prongs, and junction member are free to travel in device-actuating cleaning movements around the insulator and surrounding equipment without physical clearance issues.

DETAILED DESCRIPTION OF THE INVENTION

Figure 1:
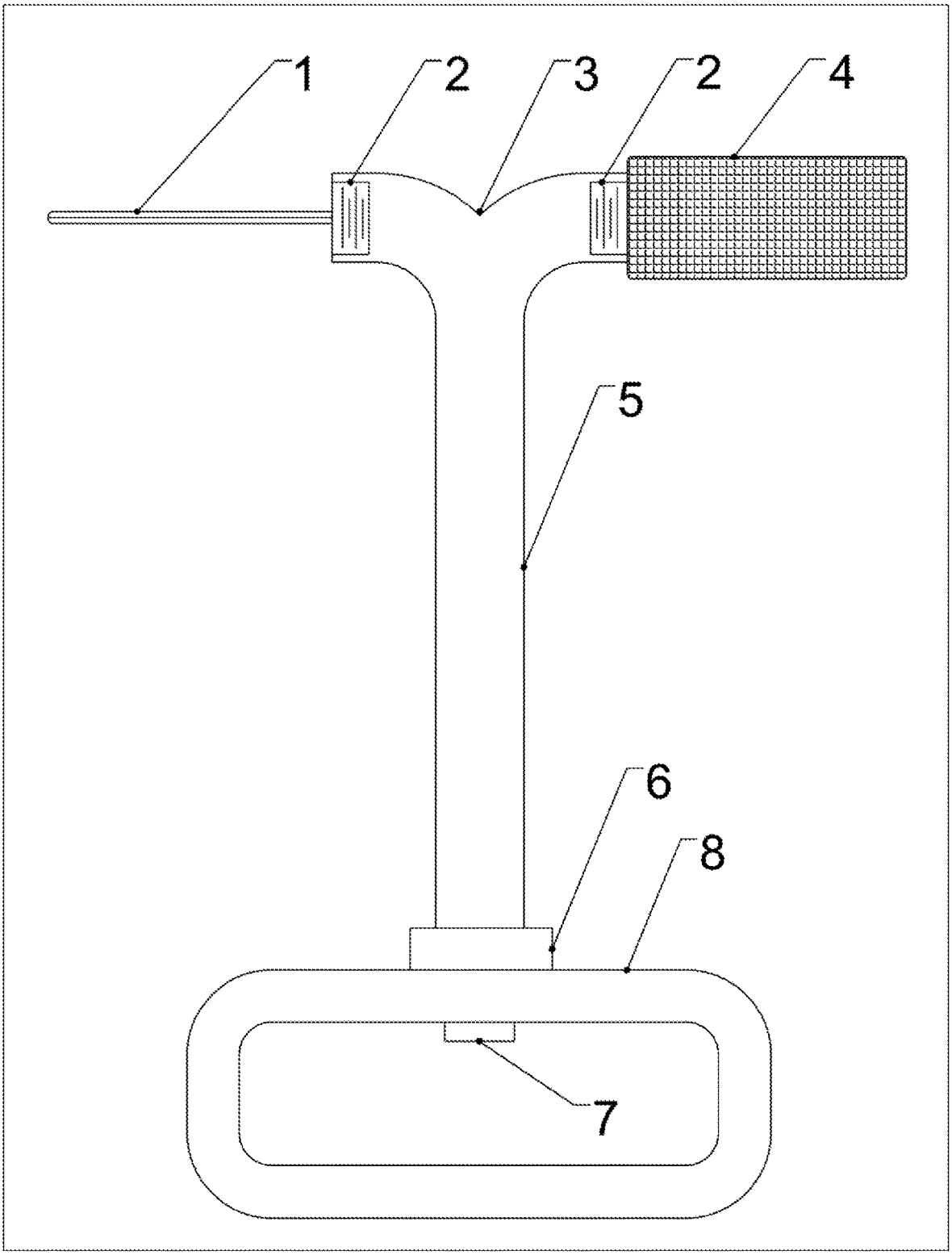
FIG. 1 is a top view of the device, where (1) is a flexible rubber blade attachment which wipes glass surfaces, (2) is a threaded connection port between the cleaning attachments and the rest of the device, (3) is the branching head which connects with (1) and the spongiform cleaning attachment (4) and which extends from the rigid support prong (5). The support prong (5) bonds with the junction member (6), where the handle (8) attaches to the junction member (6) with the swivel bushing (7).
Figure 2:
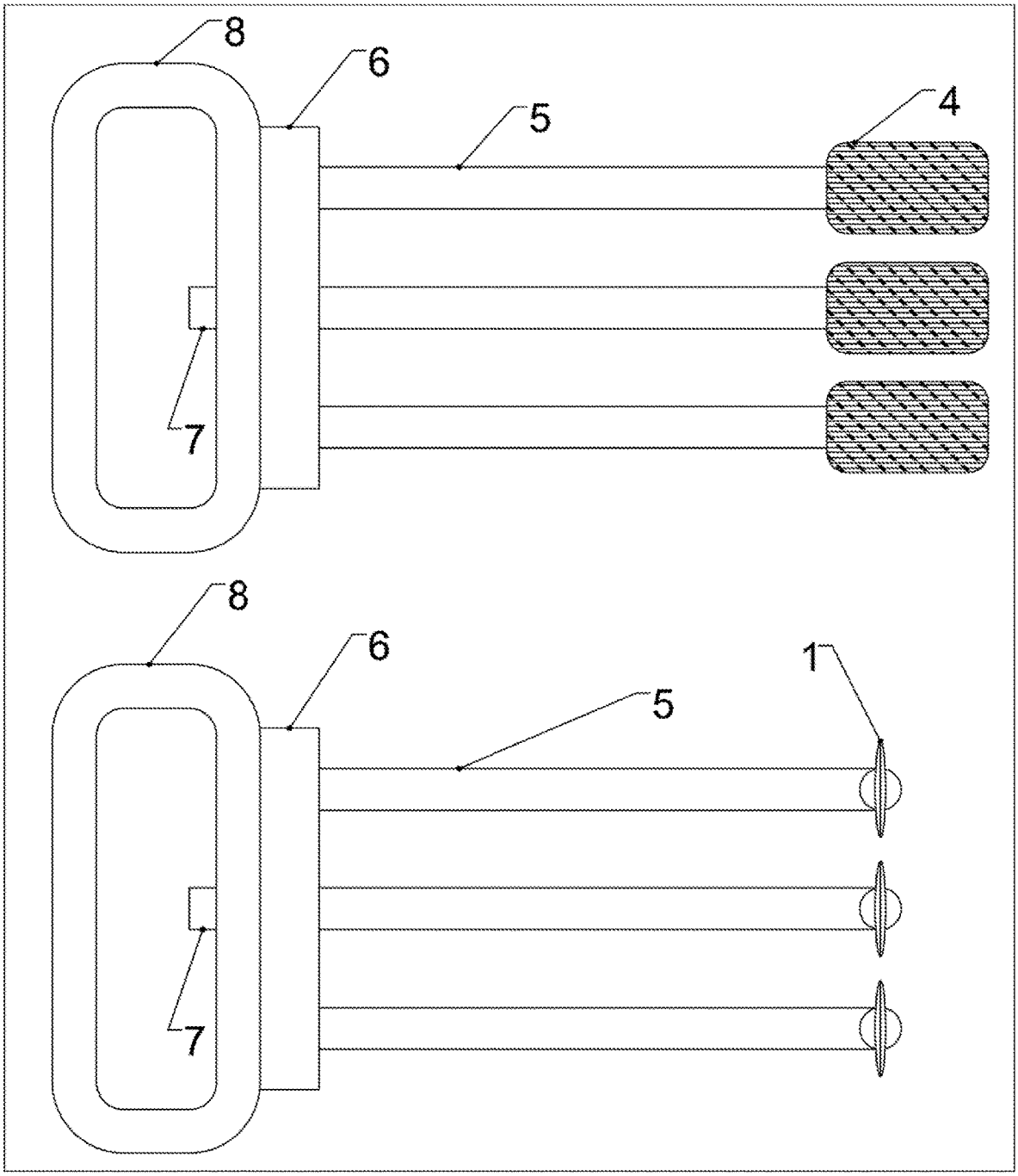
FIG. 2 is a side-view of the device, to show the perpendicular orientation of the blades (1) and sponges (4) relative to the rigid support prong (5), while the handle (8) is shown in a different orientation from FIG. 1 due to the swivel action of the bushing mechanism (7) about the junction member (6).
Figure 3:
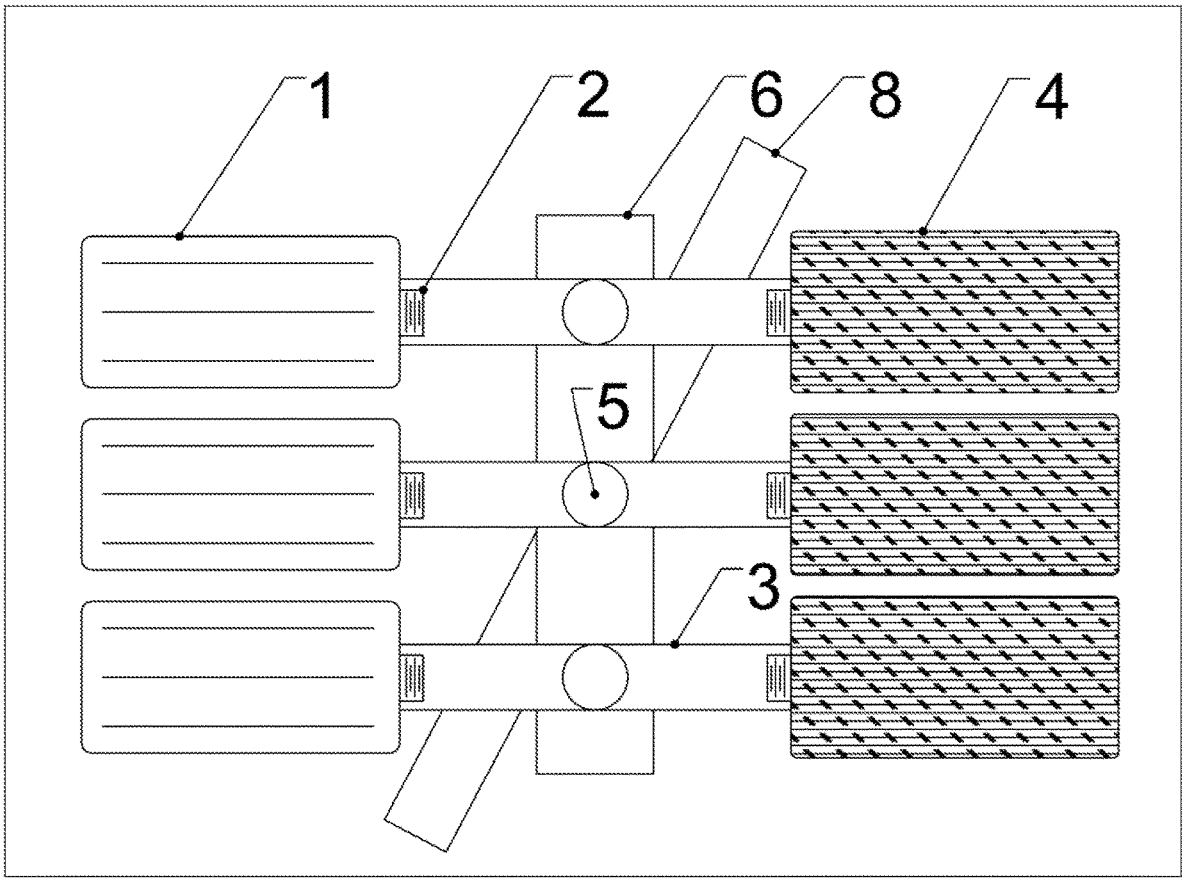
FIG. 3 is a front view of the device, again showing the perpendicular and orthogonal orientation of the blade cleaning attachment (1) and the spongiform cleaning attachment (4) with respect to the rigid support prong (5). The connection ports (2) show the interface between (1),(4) and the branched head (3), which allows for interchanging of cleaning attachment parts. The diagonal orientation of the handle (8) shows the potential for the handle to spin in all directions relative to the rest of the device.
Figure 4:
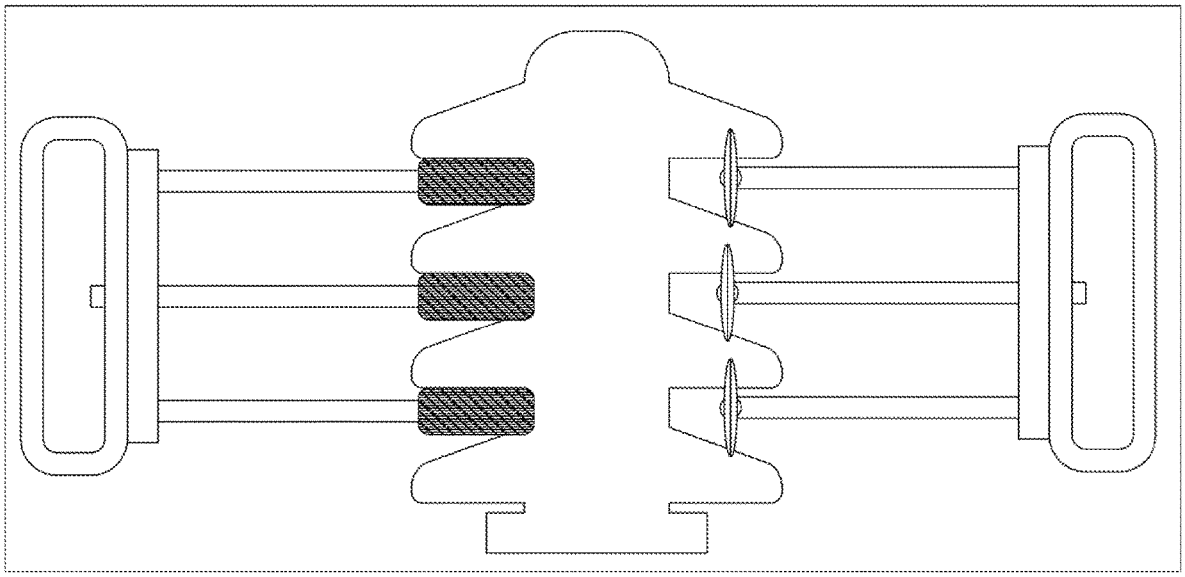
FIG. 4 demonstrates the potential for placement of the cleaning sponges and cleaning disks in the interstitial regions of the insulator disks, to cover the total surface area of the disk insulators when the device is swept in an angular motion around the insulator, in a concentric circle around the center of the disks while making full contact between the cleaning sponge or disk and the insulator surface.

The device is intended to be constructed of non-conducting polymer, such that it has a high overall insulation rating. Maintaining the electrical non-conductivity of the device is critical to its design, such that no metallic materials would be used for its construction. Thermo-welded plastic may be used to create the geometry specified in the design, where the cleaning attachments can be changed out according to insulator design, where the inter-disc regions will have different surface geometry for the attachments to conform to.

The cleaning attachments (1) and (4) extend away from the connection ports (2) and the branched head (3) of the support prong (5) so that (1) and (4) completely fill the inter-disc region and the device can be actuated without physical clearance issues relative to the insulator stack. The device can be operated in either a push or pull manner, as the rigid support prong (5) will transmit force in either direction relative to the handle (8) and the prong junction member (6). The junction member (6) has connection points for the ends of the rigid prong (5), such that at least three prongs are equidistantly spaced along the junction member (6) which is linked with the handle (8) through a swivel bushing mechanism (7). This allows the handle to turn in any direction relative to, and along a parallel axis with, the cleaning attachments when (1),(4) are cleaning within the inter-disc region.

The invention claimed is:

1. An electrically insulated and multi-pronged cleaning device which conforms to the surfaces of stacked electrical insulator discs of a high voltage power transmission and distribution system to simultaneously clean multiple insulation discs, the cleaning device comprising: a handle piece comprising of a loop; a prong junction member, which connects to said handle, and which has at least three equidistant bolted or welded hardware connections along its length; and, at least three rigid and extending support prongs, wherein each extending support prong attaches respectively to one of the hardware connections on the prong junction member at a first end of the support prong, each support prong having a head at a second end, opposite the first end, wherein each head branches to have a first threaded attachment port, and a second threaded attachment port oppositely oriented from the first threaded attachment port, where each first threaded attachment port is attached to a corresponding flexible rubber bladed cleaner attachment for wiping fluids, and each second threaded attachment port is attached to a corresponding liquid absorbent cleaner attachment, for disbursing fluids and scrubbing stains.

* * * * *